US006183490B1

(12) United States Patent
Korbar et al.

(10) Patent No.: US 6,183,490 B1
(45) Date of Patent: Feb. 6, 2001

(54) PIERCING SYSTEM

(76) Inventors: Augustin Korbar, 631 Glendale Ave., Orange, CA (US) 92865; Richard Schioldager, 2836 Fairfield St., San Diego, CA (US) 92110; Steven Danno, 5476 Paseo del Lago East, Unit C, Laguna Hills, CA (US) 92653

( * ) Notice: Under 35 U.S.C. 154(b), the term of this patent shall be extended for 0 days.

(21) Appl. No.: 09/264,498

(22) Filed: Mar. 8, 1999

(51) Int. Cl.[7] ..... A61B 17/34
(52) U.S. Cl. ..... 606/188
(58) Field of Search ..... 606/188, 167, 606/181, 185, 184, 117

(56) References Cited

U.S. PATENT DOCUMENTS

| | | | | |
|---|---|---|---|---|
| D. 252,867 | | 9/1979 | Mann | D11/76 |
| D. 347,895 | | 6/1994 | Mann | D24/146 |
| D. 363,218 | | 10/1995 | Mann | D9/428 |
| 3,500,829 | | 3/1970 | Abramowitz | 128/215 |
| 3,901,243 | | 8/1975 | Read | 128/329 |
| 3,941,134 | | 3/1976 | McDonald | 128/330 |
| 3,943,935 | | 3/1976 | Cameron | 128/330 |
| 4,030,507 | | 6/1977 | Mann | 128/330 |
| 4,068,668 | * | 1/1978 | Moore et al. | 606/188 |
| 4,146,032 | | 3/1979 | Rubenstein | 128/330 |
| 4,164,224 | | 8/1979 | Hastings | 128/330 |
| 4,191,190 | | 3/1980 | Hastings | 128/330 |
| 4,921,494 | | 5/1990 | Neil | 606/188 |
| 5,004,470 | | 4/1991 | Mann | 606/188 |
| 5,004,471 | | 4/1991 | Mann | 606/188 |
| 5,007,918 | | 4/1991 | Mann | 606/188 |
| 5,263,960 | | 11/1993 | Mann | 606/188 |
| 5,350,394 | | 9/1994 | Mann | 606/188 |
| 5,360,434 | | 11/1994 | Mann | 606/188 |
| 5,389,105 | | 2/1995 | Mann | 606/18 |
| 5,690,665 | | 11/1997 | Mann | 606/188 |
| 6,048,355 | * | 4/2000 | Mann et al. | 606/188 |

OTHER PUBLICATIONS

"Laserweld Needle Tube Specifications," dated Feb. 12, 1991, 4 pgs., K. Tube Laserweld Technology of San Diego, CA.

Hart Enterprises, Inc. brochure, undated, 9 pgs., Hart Enterprises, Inc. of Wyoming, MI.

*System 75 by Studex: The New State of the Art in Ear Piercing,* 5 pgs., Studex of Harbor City, CA.

*Inverness™ Ear Piercing Training Manual,* 1998, 29 pgs., Inverness Corporation of Fair Lawn, NJ.

* cited by examiner

*Primary Examiner*—Kevin Truong
(74) *Attorney, Agent, or Firm*—Stetina Brunda Garred & Brucker

(57) ABSTRACT

Improved earring alignment piercing systems. In a first embodiment, the invention comprises first and second cartridges axially alignable with one another that may be deployed utilizing conventional deployment mechanisms. In the first cartridge, there is housed therein a compression disk, guidance member, piercing earring having a piercing pin formed thereon, and an alignment member arranged in a generally linear configuration. The second cartridge houses a clasp that, in use, receives and secures the piercing pin as the latter is advanced through said tissue and into the clasp. The guidance member and alignment member cooperate to insure that the piercing pin forms a generally straight pathway as the same is penetrated through tissue. In a second embodiment, there is provided a piercing earring having an elongate shaft portion with a cannula member detachably mounted thereon. Such earring is preferably utilized within a two cartridge delivery system, with a receiving cartridge preferably containing a chamber for receiving and isolating the cannula member once the same has advanced through the tissue and penetrates into such chamber. In such embodiment, the shaft portion of the piercing earring may be formed of a shape-memory alloy, such as nitinol.

7 Claims, 2 Drawing Sheets

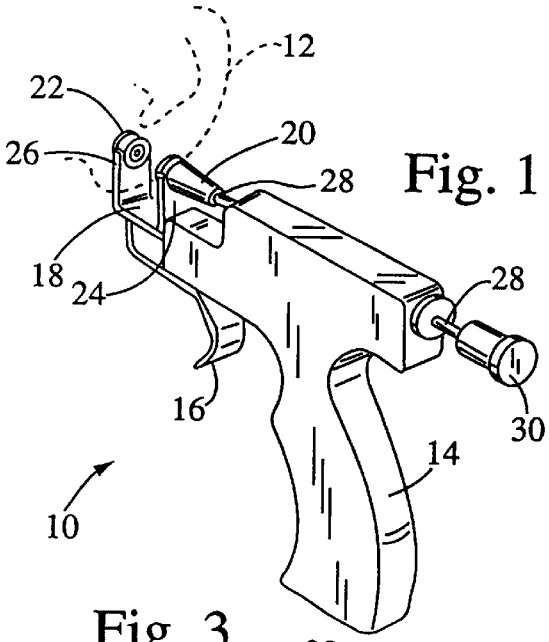
Fig. 1
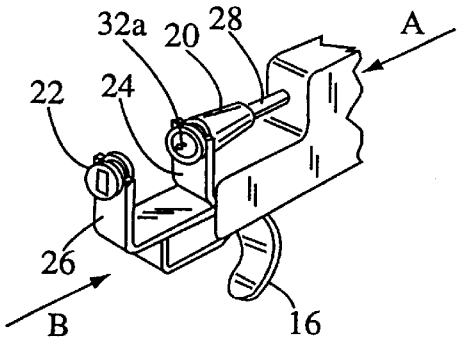
Fig. 2
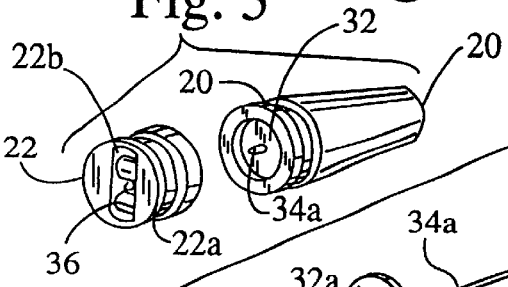
Fig. 3
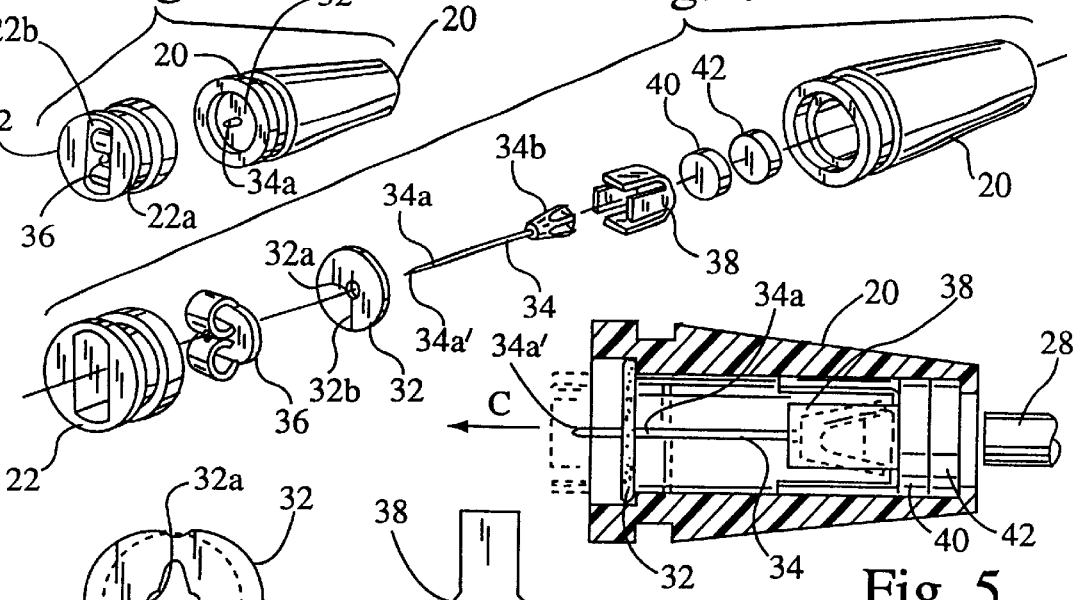
Fig. 4
Fig. 5
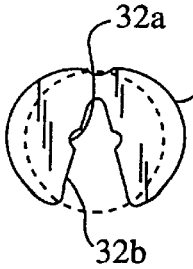
Fig. 6
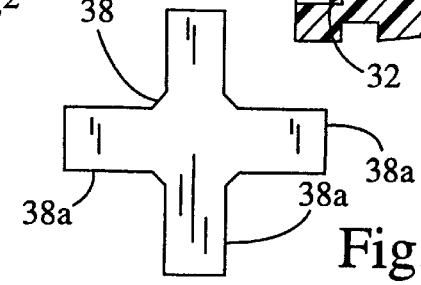
Fig. 7

PIERCING SYSTEM

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

Ear and body piercing systems are well known in the art. In this regard, it has been fashionable for centuries for jewelry to be worn through piercings made through the skin, and in particular, the ear lobes, nostrils, and more recently, the umbilicus or navel. Indeed, recent trends seem to indicate that virtually all sites upon the body are susceptible to piercing.

Typically, most piercings are formed by a piercing earring or stud having an enlarged portion, which may comprise a bead or mounted gemstone, and an elongate piercing pin extending therefrom, the latter also referred to as either a post or shaft. The distal-most end of the piercing post or shaft is typically sharpened, or may even be blunt, and is caused to force through the tissue by a deployment device, the latter typically comprising a piercing gun, such as those produced by Studex, Inc. of Harbor City, Calif., and Inverness Corporation of Fair Lawn, N.J.

Essentially, such piercing gun assemblies are designed to be manually held and have formed thereon a saddle or U-shaped recess into which is inserted the tissue (e.g., ear lobe) sought to be pierced. The piercing earring sought to be introduced through such tissue is typically provided in a cartridge form with the piercing earring being disposed in a first cartridge on a first opposed side of the tissue disposed within the recess. A second cartridge housing a clasp or catch member is aligned with the first cartridge on the respective other opposed side of the tissue sought to be pierced. In operation, the gun assembly, by applying a linear force to the piercing earring housed within the first cartridge, causes the distal end of the piercing post of the piercing earring to force through such tissue captured within the gun's recess and thereafter become nested within the clasp member housed within a second cartridge aligned therewith on the opposed side of the tissue. The piercing earring remains resident within the tissue until such time as the tissue initially heals, which on average with reasonable care can take approximately four to eight weeks for soft tissue and up to a year for piercings formed through cartilage. After about six months, healing is complete and a piercing hole is permanently formed through which earrings and the like may be introduced and affixed.

While such prior art devices are generally effective in piercing through and forming the necessary channels through tissue within which jewelry can be secured, such prior art devices suffer from numerous drawbacks. Significant among these drawbacks includes the high degree of trauma that is produced as the piercing post is caused to extend through tissue. In this regard, the distal-most end of most prior art piercing pins typically rip and tear through tissue, as well as force tissue to become displaced radially about the elongate pathway formed by the piercing post.

As a consequence, substantial trauma is inflicted to the tissue which not only produces pain and a prolonged healing process, but also increases the risk that the tissue can become infected or otherwise inflamed. Prolonged healing time increases the potential for infection insofar as the open wound becomes particularly susceptible to bacterial infection. The risk of infection is further significantly increased by the typical impatience of individuals who want to change jewelry (i.e., replace the piercing earring) before the pierced tissue fully heals. In fact, to the extent such piercing earring is prematurely removed, the piercing formed by the piercing earring heals and ultimately closes, thus defeating the entire piercing experience. Such problems are especially common among younger individuals. In this regard, the widely acknowledged contributing factor to such problems is the belief of the customer that, after piercing, the pierced hole will be permanent in six weeks, as opposed to the more correct time of six months.

This potential for pain and discomfort can be further aggravated by such prior art systems insofar as the enlarged portion of the piercing earrings deployed thereby can be caused to bluntly slap or compress against the tissue once the piercing post has pierced or "shot"through a given cross-section of tissue. The impact that such larger ball or gemstone portions make against such tissue may cause further pain and trauma.

Ideally, it is known in the medical arts and body piercing arts that the preferred method for forming pierced passageways through tissue is through the use of surgical cannulas or needles with razor tops, and especially with tips specifically designed to core out a generally cylindrical pathway through a given section of tissue. In this regard, the razor leading edge of the cannula has the advantage of neither ripping nor tearing tissue, and likewise does not cause any tissue displacement, which produces the traumatic outcomes of the aforementioned prior art systems. Unfortunately, however, to form such type of piercings typically requires that the same be formed by physicians or other skilled health workers in clinical settings, which is viewed as exceedingly expensive, inconvenient and intimidating.

Accordingly, there is a need in the art for an earring piercing alignment system that can produce piercings through tissue in a manner that is substantially less traumatic, requires less healing time, minimizes the risk of infection than prior art systems and allows an individual to change earrings at will.

BRIEF SUMMARY OF THE INVENTION

The present invention specifically addresses and alleviates the above-identified deficiencies in the art. In this regard, the present invention is directed to an ear piercing system that produces piercings through tissue in a manner that is substantially more atraumatic than prior art systems.

According to a first preferred embodiment, the invention comprises a cartridge system comprising first and second cartridges that are mountable upon conventional piercing deployment mechanisms, such as gun-type mechanisms and the like. The first cartridge comprises an elongate, generally cylindrical cartridge member having proximal and distal ends within which are housed at least one abutment member or compression disk, a guidance member, which preferably comprises a thin sheet of plastic material formed as a cross which defines a plurality of finger members, an elongate piercing earring having proximal and distal ends that includes an enlarged portion formed on the proximal end thereof and a piercing pin extending therefrom, and an alignment member axially disposed about the piercing pin. The compression disk, guidance member, piercing earring, and alignment member are arranged longitudinally in a generally linear fashion from the distal end to proximal end of the first cartridge member. The second cartridge comprises a cylindrical cartridge member that is axially alignable that has housed therein a clasp or catch member that, in use, is designed to receive and engage the distal end of the piercing pin when the latter is forced through a section of tissue.

According to a second preferred embodiment, there is provided a novel piercing earring, which includes an enlarged portion and a shaft extending therefrom, and a cannula member having a beveled distal tip and a lumen extending therethrough detachably mounted upon the distalmost end of the piercing earring shaft. The cannula member is so mounted upon the shaft portion of the piercing earring that, in use, once the piercing earring is deployed, the cannula cuts a razor edge coring type incision through the cross-section of tissue sought to be pierced. As a consequence, minimal tearing or displacement of the tissue occurs.

In a further refinement of the invention, an insulating material may be disposed within all or a portion of the lumen of the cannula. Alternatively, the post portion of the piercing earring comprises an implantable grommet member having a conventional earring, and more particularly the post thereof, mounted therewithin. In such embodiment, the grommet remains resident within the tissue for a prolonged duration, which can last from a few weeks to several years, which defines a pathway through which conventional earrings and the like can be immediately worn and changed, thus dispensing with the requirement that the piercing heals before the piercing earring is removed and other earrings placed thereinstead. Still further, the piercing earring may be formed such that the post portion thereof is formed from a shape-memory material, such as nitinol, that selectively transitions to a configuration that secures the earring into position following deployment.

The novel piercing earrings of the present invention may be utilized with cartridge systems mountable upon a conventional earring delivery/deployment apparatus or may be utilized with the aforementioned alignment apparatus of the present invention. However, to provide a greater degree of safety during operation, the second cartridge of the piercing system is preferably provided with a dedicated chamber to capture and isolate the cannula portion once the same has extended through the tissue and into the second cartridge aligned therewith, and optionally a second dedicated chamber for housing a clasp member for receiving and engaging with the distal end of the shaft portion of the piercing earring. In a preferred version of a cartridge system for deploying the novel piercing earrings of the present invention, a second cartridge member is provided that does not include a clasp in those embodiments where the shaft portion of the piercing earring disposed within the first cartridge is formed from the shape-memory material, such as nitinol.

It is therefore an object of the present invention to provide an earring alignment piercing system that enables an earring to be pierced through tissue in a manner that is substantially more atraumatic than piercings produced by prior art systems.

Another object of the present invention is to provide an earring alignment piercing system that may be readily utilized with virtually all types of conventional earring deployment mechanisms and guns currently in use.

A still further object of the present invention is to provide an earring alignment piercing system that is of simple construction, inexpensive to manufacture, may be utilized in substantially all types of piercing upon substantially all sites upon the body, and may be easily utilized by individuals having minimal piercing training or experience.

BRIEF DESCRIPTION OF THE SEVERAL VIEWS OF THE DRAWING

These, as well as other features of the present invention will become more apparent upon reference to the drawings wherein:

FIG. 1 is a perspective view of a prior art piercing earring gun for deploying a piercing earring through an ear lobe.

FIG. 2 is an enlarged perspective view of the deployment portion of the prior art deployment gun depicted in FIG. 1, which further depicts first and second cartridges housing the earring piercing alignment system of the present invention.

FIG. 3 is a perspective view of the first and second cartridges depicted in FIG. 2 housing the novel earring piercing alignment system of the present invention.

FIG. 4 is an exploded perspective view of the components comprising the novel earring piercing alignment system of the present invention.

FIG. 5 is a cross-sectional view of the components housed in the first cartridge of the novel earring piercing alignment system of the present invention.

FIG. 6 is frontal view of an alignment member utilized in the piercing alignment system of the present invention constructed according to a preferred embodiment.

FIG. 7 is a frontal view of a guidance mechanism utilized in the piercing alignment system of the present invention constructed according to a preferred embodiment.

DETAILED DESCRIPTION OF THE INVENTION

Figure 8:
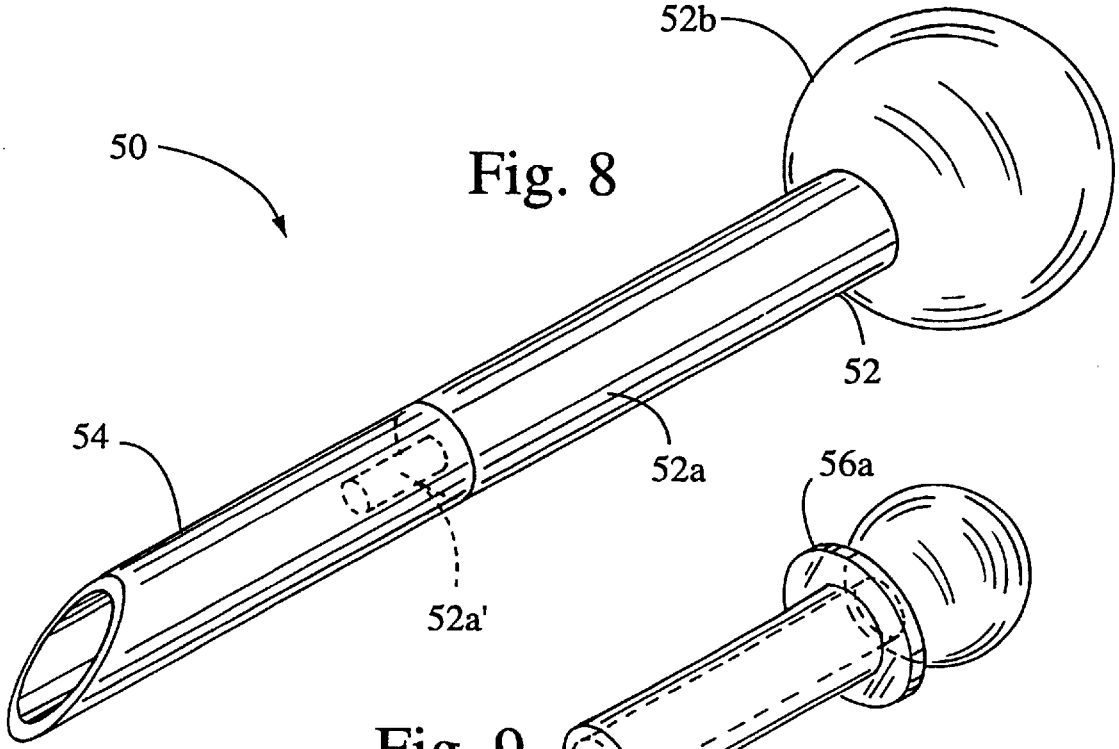
FIG. 8 is a perspective view of a piercing earring having a cannula member mounted thereon constructed in accordance with a preferred embodiment of the present invention.

The detailed description as set forth below in connection with the appended drawings is intended as a description of the presently preferred embodiments of the invention, and is not intended to represent the only form in which the present invention may be constructed or utilized. The description sets forth the functions and sequences of steps for constructing and operating the invention in connection with the illustrated embodiments. It is understood, however, that the same or equivalent functions and sequences may be accomplished by different embodiments and that they are also intended to be encompassed within the scope of this invention.

Referring now to the figures, initially to FIG. 1, there is shown a conventional deployment system 10 utilized for forming piercings through tissue, such as ear lobe 12. Typically, such prior art systems utilize a deployment mechanism or gun 14 that causes a piercing earring (not shown) housed within a first cartridge 20 to be shot or pierced through the target site of tissue 12 and remain embedded therein until such time as the wound caused by the piercing earring heals and thus forms a passageway through which earrings or other types of jewelry can be positioned and secured. To enable the piercing earring to remain embedded within the tissue, a second cartridge 22 is provided within which is disposed a clasp, the latter being aligned with and designed to receive the piercing earring once the latter has pierced through the tissue 12.

To enable the piercing earring to be so deployed, the gun mechanism 14 is provided with a generally U-shaped recess 18 into which the tissue sought to be pierced 12 is disposed. The recess 18 is defined by opposed, upwardly extending flanges 24, 26 onto which the respective cartridges 20, 22 are mounted. In this regard, it is known in the art that such cartridges 20, 22 are typically provided with respective annular grooves 20*a*, 22*a*; more clearly seen in FIG. 3, to enable the same to be respectively mounted upon the gun device 14.

To deploy the piercing earring, such gun mechanism 14 is provided with a piston or plunger 28 that extends through the device, and is typically provided with a retraction member 30 that is rearwardly withdrawn to enable the first cartridge 20 to be mounted upon the device, and thereafter actuated via trigger member 16 such that the piston member 28 forces the piercing earring to advance through the tissue and into the second cartridge 22 aligned therewith, more clearly seen in FIGS. 1 and 2. In this respect, when trigger 16 is actuated, the plunger mechanism 28 is advanced forward in the direction indicated by the letter A, shown in FIG. 2. Simultaneously, second cartridge 22 advances in the direction indicated by the letter B so that the distal-most end of the piercing pin 32*a* is caused to mate therewith.

As more clearly seen in FIG. 3, the coaxial alignment of the first and second cartridges 20, 22 is specifically designed to cause the distal-most end 34*a*' of the piercing earring to penetrate through and become received within clasp 36 mounted within recess 22*b* formed upon the second cartridge 22. Unlike prior devices, however, in the cartridge arrangement depicted in FIG. 3, and more clearly depicted in the exploded view provided in FIG. 4, there is provided an improved earring alignment system that enables piercing earrings to be pierced through tissue with less traumatic impact than prior art earring piercing systems. In this regard, first and second cartridges 20, 22 are provided with the aforementioned annular grooves 20*a*, 22*a* to enable the same to be mounted upon such conventional deployment devices. Additionally, similar to prior art devices, the first cartridge 20 is provided with a piercing earring 34, more clearly depicted in FIG. 4, that is designed such that the piercing pin portion 34*a*, and more particularly the distal-most end 34*a* 'thereof, is shot or otherwise rapidly advanced through tissue and ultimately protrudes through and becomes nested within a clasp 36 nested in a recess or aperture 22*b* formed upon the second cartridge 22.

As will be appreciated by those skilled in the art, the piercing earring 34 may take any of a variety of configurations of piercing earrings known in the art, which typically include a piercing pin portion 34*a* having a distal tip 34*a* ' that is specifically configured and oriented to be advanced through tissue. The piercing earring 34 additionally includes an enlarged jewelry portion 34*b*, which may take the form of either a bead or a gemstone captured within a series of prongs, as shown.

According to the present invention, the piercing earring 34 is disposed between an alignment apparatus 32, which preferably takes the form of one or more annular disks made of paper, cloth, plastic, or any other type of similar material well known to those skilled in the art, and a guidance member 38. The alignment member 32 is provided with a centrally disposed aperture 32*a* with an elongate slit 32*b* extending therethrough. The alignment member 32 is radially disposed about the piercing pin portion 34*a* of the piercing earring 34, as shown in FIG. 3. Although the embodiment depicted illustrates only one alignment member 32, it is contemplated that additional alignment members 32 may be situated along the length of the piercing pin portion 34*a* of the piercing earring 34.

The guidance member 38, positioned about the respective other opposed end of the piercing earring 34, is preferably formed from a thin plastic material, such as polyethylene and the like, and may be preferably formed as a cross as shown in FIG. 7. In this regard, the guidance member 38 may be provided with a series of arms or fingers 38*a* that, in use, are utilized to fold about the bead or jewelry portion 34*b* of the piercing earring 34, as shown in FIGS. 4 and 5, and push against alignment member 32 as the earring 34 is pierced through tissue. In this respect, the fingers 38*a* of guidance member 38 forces alignment member 32 forward out of the cartridge 20 and against the outer layer of skin of the ear.

At least one and preferably two compression disks or spacers 40, 42 are further provided in the first cartridge that are designed to transmit the force of energy produced by piston 28 when the latter is actuated by trigger 16 of the deployment device 14. Such compression disks 40, 42 further have a dual purpose as spacers to thus provide adjustment means for the first cartridge 20 to house piercing earring 34 having longer or shorter lengths.

Referring now to FIG. 5, there is depicted a cross-sectional view of the first cartridge 20 housing the novel alignment system of the present invention. As illustrated, the piercing earring 34 is mounted within the cartridge 20 such that the piercing pin 34*a* thereof extends axially through alignment member 32, with the distal-most end 34*a* 'of the piercing pin extending therethrough. As will be appreciated by those skilled in the art, as piston 28 causes piercing earring 34 to advance forward, the alignment member 32 will cause the piercing pin portion 34*a* thereof to advance in a substantially straight pathway, indicated by the letter C, and thus prevent the same from veering off at an angle, as frequently happens with prior art devices.

Similarly, the guidance member 38, which is disposed about the enlarged jewelry portion 34*b* of the piercing earring, causes the driving force of energy transmitted by piston 28 to be radially distributed about the enlarged portion 34*b* and thus causes the same to advance in a generally straightforward manner insofar as such enlarged portion 34*b* is prevented from moving up, down or to the side as the same is being advanced through the target site of tissue. In addition, and as discussed above, the arms or fingers 38*a* of guidance member 38 compress about alignment 32 to cause the latter to compress about the point of entry through which the piercing earring 34 is introduced into the skin.

In addition to producing a substantially straight pierced pathway, the system of the present invention can further minimize some of the trauma experienced during such procedure by virtue of the compressive cushioning provided by alignment member 32, especially when the jeweled portion 34*b* impacts the tissue. As will be appreciated by those skilled in the art, as the piercing pin portion 34*a* of the piercing earring 34 advances through the tissue and ultimately becomes received within clasp 36 nested within second cartridge 22, the enlarged jeweled portion 34*b* will ultimately be caused to slap or compress against the entryway of the pierced tissue. As is well known by those skilled in the art, the compressive force by which such portion 34*b* compresses against the tissue produces substantial pain and inflammation, and can create a negative piercing experience. Advantageously, however, alignment member 32 has been shown to absorb a substantial portion of the impact made by jeweled portion 34*b* to the extent the same impacts the tissue, and thus substantially minimizes the discomfort associated with such impact. Furthermore, such guidance system 32 may be easily removed following such impact insofar as the same is provided with elongate slot 32*b* which, as depicted in FIG. 6, enables the same to be easily removed from its position interposed between the tissue and the enlarged jeweled portion 34*b* following the piercing, and thereafter discarded.

Referring now to FIGS. 8–11, and initially to FIG. 8, there is shown an improved piercing earring system 50 constructed in accordance to a preferred embodiment that produces substantially less traumatic piercings than prior art piercing earrings. As per conventional piercing earring systems, the system 50 of the present invention includes a piercing earring 52 having an enlarged portion 52*b*, which may take the form of a bead, mounted jewel or the like, and an elongate shaft portion or post 52*a*. A mounting post 52*a*', shown in phantom, is disposed upon the distal-most end of shaft portion 52*a*. As per conventional earrings, it is contemplated that the earring systems of the present invention may be formed inert metal, such as titanium, 14-karat gold, platinum, and surgical stainless steel, that are typically utilized in jewelry applications.

Detachably mounted upon the mounting post 50*a*' is a beveled cannula member 54 having a hollow lumen extending therethrough. Although depicted as a beveled cannula, it should be recognized that cannula member 54 may take any of a variety of conventional biopsy needle designs known, such those produced by Hart Enterprises, Inc. of Wyoming, Mich. or later developed in the art. The cannula member 54 is specifically designed and adapted to core out a pathway through the tissue as the same is advanced therethrough. Advantageously, unlike prior art systems, by using a razor edge top to cut and preferably core through the tissue, the tissue undergoes minimal tearing which is known in the art to occur by barbed or blunt piercing earrings that do nothing more than merely advance through and displace tissue. Such prior art practices are known to produce significant swelling and inflammation, as well as increase the chance of infection. Additionally, healing times are substantially prolonged due to such prior art techniques.

Figure 10:
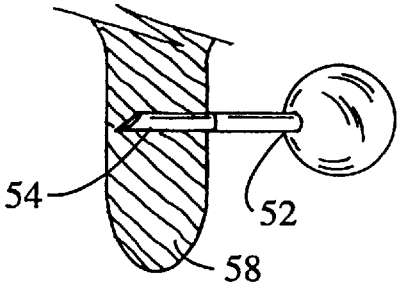
FIG. 10 is a cross-sectional view of the piercing earring with cannula member formed thereon as depicted in FIG. 8 shown advancing through a cross-section of tissue.
Figure 11:
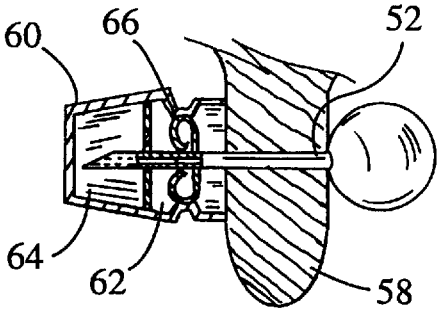
FIG. 11 is a cross-sectional view of the piercing earring with cannula member formed thereon of FIG. 10 with the piercing earring shown advanced through the tissue and the piercing member being secured in a receiving cartridge.

Trauma is further minimized by virtue of the design of the present invention insofar as the detachable cannula portion 54 is mounted upon shaft portion 52*a* of the piercing earring 50 such that the same forms a continuous cylindrical body as the same is advanced through tissue, as shown in FIG. 10. Because the cannula member 54 will be coring out a (generally cylindrical) portion of tissue, there may be disposed within the cannula 54 gauze or the like to insulate and absorb such tissue, blood, etc. The cannula 54 and elongate portion 50*a* of the piercing earring may additionally be coated with an anesthetic or antimicrobial agent, or both, as may be necessary for a given application. Although not shown, it is further contemplated that the piercing earring 50, and more particularly the cannula 54 mounted thereon, can minimize trauma even further to the extent the same is deployed such that the cannula 54 is simultaneously rotated while being axially advanced through the target site of tissue. In this regard, it is well known in the art that trauma is minimized to the extent a rotational shearing force is applied when coring out tissue, as has been established in medical biopsy procedures.

Figure 9:
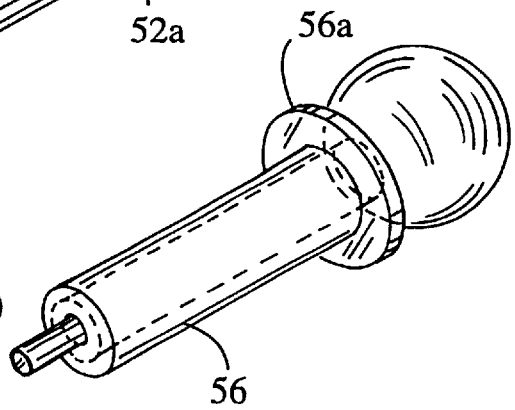
FIG. 9 is a perspective view of an alternative embodiment of the piercing earring depicted in FIG. 8.

In an alternative configuration depicted in FIG. 9, the shaft of the piercing earring 50 may comprise an elongate cylindrical sleeve or grommet 56 formed of a biocompatible material, such as Teflon, within which is nested an elongate shaft 56, the distal-most end defining a mounting post. In such embodiment, the sleeve or grommet 56 is specifically designed to embed and reside within the channel of cored out tissue produced by the cannula 54 mounted thereon. In this respect, grommet 56 may be provided with an annular collar 56*a* formed about the proximal end thereof which serves to radially abut about the tissue defining the entryway into the piercing and provide means for anchoring the grommet 56 axially within the formed piercing. As a consequence, grommet 56 will provide the individual with a rigid channel or pathway through which he or she may insert earrings and the like and change jewelry, which is not available via piercings made directly through flesh insofar as such piercings necessarily require that the tissue heal about such piercing, which can take up to several months for most individuals. In an alternative embodiment, the grommet 56 may be formed of a relatively flexible material to thus enable individuals to readily insert and affix earrings or other type of jewelry having arcuate contours, such as hoops and the like.

In yet a further embodiment not shown, the sleeve or grommet 56 may be axially disposed within the cannula member 54 such that when deployed, the grommet 56 is cylindrically encased within the cannula 54. In this regard, it is contemplated that when deployed, the cannula 54 will be advanced completely through the tissue, as per the aforementioned embodiments, with the grommet 56 remaining embedded therewithin by virtue of the anchoring effect provided by annular collar 56*a* formed upon the proximal end of such grommet, similar to that depicted in FIG. 9.

Advantageously, by introducing grommet 56, there is thus substantially reduced, if not eliminated, the possibility of infection that can occur in those individuals impatient with the healing process and who want to rapidly change jewelry following the formation of a piercing. As is widely known, prematurely changing jewelry following the formation of a piercing can greatly increase the chances that an infection can develop at the piercing site, thus significantly prolonging healing time, and increasing customer frustration.

To enhance the safety during utilization of such novel piercing earring system 50, in particular to isolate the cannula member 54 mounted thereon, it will be recognized that following the insertion of the piercing earring 52 through a given cross-section of tissue 58, as depicted in FIG. 10, it will be necessary to capture and isolate the cannula member 54 utilized to form the passageway therethrough. To that end, it is contemplated that a specialized cartridge, such as 60 depicted in FIG. 11, will be utilized to not only house a clasping means 66 for securing the piercing earring 52 into position within the tissue 58 once the same has been advanced therethrough, but will also facilitate the isolation of the cannula member 54 utilized as part of the piercing process. As shown, cartridge 60 is provided with first and second chambers 62, 64, the first chamber 62 being utilized to house a clasp member 66 and orient the same to face the oncoming cannula member 54 as the latter is advanced axially therethrough, and a second chamber 64 for capturing and isolating the cannula member 54 once the same comes into contact therewith. Along these lines, it is contemplated that the cannula member 54 may be caused to dislodge or disconnect from mount 52a' once the mount is caused to force through the clasp secured within such cartridge 60. Specifically, it is contemplated that the cannula member 54 will be caused to extend through the clasp 66 and thereafter become isolated within the second chamber 64.

It should be recognized, however, that as opposed to requiring a specialized, two-chamber receiving cartridge 60 as discussed above, such cartridge may function merely to isolate the cannula member 54 and not provide a clasp 66 disposed therein for securing the piercing earring 52 into position once the same has been engaged therewith. In this regard, it is contemplated that such clasp member 66 may be manually fastened to the piercing earring 52 in a second step once the cannula member 54 has been deployed through the tissue and isolated within the receiving cartridge 60.

In yet another alternative embodiment, as opposed to utilizing a straight shaft member 52*a* that must necessarily engage with a clasp member, such shaft portion 52*a* of the piercing earring 52 may be formed of resilient, self-expanding or self-contracting material which is biased to an operative configuration whereby the distal portion thereof assumes an arcuate or coiled anchoring configuration such that when unconstrained, the shaft portion 52*a* will assume a configuration that insures that the earring 50 remains securely within the piercing formed thereby. In this regard, it will be recognized that such shaft portion 52*a* will initially be formed to assume the elongate insertion configuration shown in FIG. 8, or may be housed in such configuration within sleeve 56 depicted in FIG. 9, but can subsequently be deformed to assume the operative configuration allowing the same to remain anchored within the piercing.

As a still further alternative, such shaft portion 52*a* may be formed from a shape-memory material, such as nitinol, which thus enables the shaft portion 52*a* of the earring 50 to assume the insertion configuration depicted in FIG. 8 when at room temperature, but transition to the arcuate or anchoring configuration when warmed to body temperature, as will occur once such portion 50*a* remains sufficiently embedded within the tissue to become warmed to room temperature. Advantageously, to the extent it becomes necessary to remove or otherwise reposition such earring 52, it will be recognized by those skilled in the art that removal of such earring 52 may be facilitated by merely cooling the shaft portion 52*a* by any of a variety of well-known methods, including applying cold saline thereto.

It is further contemplated that such self-anchoring properties provided by piercing earrings 52 having shaft portions 52*a* formed from shape-memory material can be accomplished with super elastic nitinol. In this regard, it is contemplated that super elastic nitinol, which is known to transition at room temperature, will be formed and deployed as a straight wire or shaft that is held within a cannula member 54. When the cannula 54 is deployed and ultimately advanced through and removed from the tissue, the super elastic nitinol shaft portion 52*a* will be allowed to return to its anchoring configuration, and thus immediately provide means for securing the piercing earring 52 into position within the tissue. In this respect, it is contemplated that the super elastic nitinol shaft portion 52*a* will be so housed and nested within the cannula member 54 that it will be restrained from assuming its anchoring configuration until such time as the cannula member 54 is axially removed therefrom.

Although the invention has been described herein with specific reference to a presently preferred embodiment thereof, it will be appreciated by those skilled in the art that various modifications, deletions, and alterations may be made to such preferred embodiment without departing from the spirit and scope of the invention. The cartridges 20, 22 utilized to house the alignment system may take any variety of shapes or forms and the alignment and guidance members may be sized and adapted to accommodate the same. Likewise, it will be recognized that any of a variety of piercing earrings may be utilized in the alignment system of the present invention, including those having blunt or sharpened ends, as well as the novel piercing earring of the invention depicted in FIGS. 8–11. Still further, it will be recognized that the cannula member 54 formed upon the piercing earring of the present invention may take any of a variety of medical needles/biopsy cannula instruments known or developed in the future. Accordingly, it is intended that all reasonably foreseeable additions, modifications, deletions and alterations be included within the scope of the invention as defined in the following claims.

What is claimed is:

1. A piercing system for forming a piercing through a section of tissue at a selected site comprising:

a) a first elongate cartridge having distal and proximal ends, said cartridge having disposed therein at least one compression disk, a guidance member consisting of a pre-formed sheet of flexible material, a piercing earring consisting of an enlarged portion and a piercing pin extending therefrom, and an alignment member consisting of a pre-formed sheet of flexible material, said at least one compression disk, guidance member, piercing earring and alignment member being disposed within such first cartridge in a generally linear configuration and in longitudinal alignment therewith;

b) a second cartridge having a clasp member housed therewithin, said clasp member being designed to receive and interconnect with said piercing pin of said piercing earring; and c) wherein said first and second cartridges are positionable upon opposed sides of said site of tissue sought to be pierced, and coaxially alignable with one another such that upon application of sufficient force to said at least one compression disk of said first cartridge, said piercing pin of said piercing earring is caused to advance through said tissue in a substantially straight fashion and interconnect with said clasp housed within said second cartridge.

2. The system of claim 1 wherein said first and second cartridges are mountable upon a conventional piercing gun.

3. The system of claim 1 wherein said guidance member is formed from a plastic material and specifically sized and adapted to cover at least a portion of said enlarged portion of said piercing earring.

4. The device of claim 3 wherein said guidance system includes at least one flap for covering at least a portion of said enlarged portion of said piercing earring.

5. The device of claim 4 wherein said guidance system is formed as a cross having four generally equal-sized flap portions.

6. The device of claim 1 wherein said alignment member comprises a thin sheet of material selected from the group consisting of paper, cloth and plastic, said guidance system being axially mountable upon said piercing pin of said piercing earring.

7. The system of claim 1 wherein said alignment member is provided with a slit extending partially therethrough to enable said guidance system to be removed from said piercing pin of said piercing earring once said piercing earring is pierced through said tissue.

* * * * *